US005174828A

United States Patent [19]

Roth

[11] Patent Number: 5,174,828

[45] Date of Patent: Dec. 29, 1992

[54] DEVICE FOR DISCHARGING AND RINSING A CONTAINER

[76] Inventor: Reginald Roth, Box 157, Landis, Saskatchewan, Canada, S0K 2K0

[21] Appl. No.: 712,869

[22] Filed: Jun. 11, 1991

[51] Int. Cl.[5] ..... B08B 9/08

[52] U.S. Cl. ..... 134/16; 134/22.1; 134/168 R; 134/198; 239/272

[58] Field of Search ..... 134/167 R, 168 R, 198, 134/16, 22.1, 42, 62; 141/329; 239/271, 272

[56] References Cited

U.S. PATENT DOCUMENTS 2,491,516 12/1949 Piggot et al. .
2,603,858 7/1952 Bruce et al. .
2,668,550 2/1954 Burge .
3,739,471 6/1973 Peres .
4,058,412 11/1977 Knapp et al. .
4,106,701 8/1978 Siefken ..... 134/167 RV
4,119,114 10/1978 Bolton et al. ..... 134/166 R X
4,497,351 2/1985 Garcia ..... 141/329
4,702,267 10/1987 Ashraff ..... 134/166 R
4,846,236 7/1987 Deruntz ..... 141/329
4,923,021 5/1990 Courmier et al. .
4,961,440 10/1990 Wright ..... 134/167 R

*Primary Examiner*—Frankie L. Stinson
*Attorney, Agent, or Firm*—Adrian D. Battison; Stanley G. Ade; Murray E. Thrift

[57] ABSTRACT

A system described herein that provides for the opening, emptying and rinsing of the interior of a chemical container. The present system allows an operator to destructively perforate the bottom of a container, empty its contents into a vessel, rinse its interior and collect the drained chemical and rinse water in a suitable receptacle, such as a sprayer tank. This system provides for maximum efficiency, and the total use of the chemical within the container, as well as a safe means for rinsing a container prior to disposal. The system provides for a minimal contact of the contents of the container by the operator. The cutting arrangement includes a plurality of elongate blades inclined upwardly to an apex and a plurality of intervening bars for opening the slit base of the container. The cutting arrangement is provided in a vessel with a transportation duct and venturi at the bottom for carrying the contents in mixed condition away from the vessel.

5 Claims, 6 Drawing Sheets

DEVICE FOR DISCHARGING AND RINSING A CONTAINER

This invention relates to a device for opening, discharging and rinsing the contents from a container.

Agricultural chemicals such as herbicides, pesticides and fertilizers are often supplied and stored in plastic containers and are usually sold in concentrated form, for later dilution with water particularly for filling a sprayer tank. These chemicals in concentrate form are often very harmful and therefore minimal contact by the operator with the contents of the container is much to be preferred.

In addition, the use and disposal of these containers when emptied poses a potential safety and health hazard, as many of the chemicals stored in these containers are quite poisonous to both animal life forms and the environment. Many jurisdictions have provided regulations dealing with the use of harmful chemicals such as those mentioned above and their containers. These regulations often require that the used chemical containers be rinsed thoroughly prior to their disposal. The rinsing process also is preferably accomplished by a person having minimal contact with the contents of the container.

One prior device is disclosed in U.S. Pat. No. 4,058,412 (Knapp) and comprises a system for emptying and washing cans in which a relatively small hole is punched into the bottom of the can and the can is allowed to drain into an enclosed vat. The contents of the vat are later discharged for use. The cans are rinsed by a hose positioned within the hole punching device.

Knapp provides an arrangement with a plurality of stations so that each station can receive a respective container for discharge of the contents. The hole punched at the bottom of the container is relatively small so that the contents will discharge very slowly, particularly bearing in mind that there is no air inlet provided so that the air must enter through the same discharge opening in a glugging action. In view of the multiple station arrangement, therefore, the device is relatively large and complex and is not transportable. The device has therefore a limited usage since it must be located at a central position and can then be only used to fill tanks which are themselves adjacent to that central position.

SUMMARY OF THE INVENTION

It is one object of the present invention, therefore to provide an improved device for opening, discharging and rinsing a container.

According to a first aspect of the invention there is provided a device for opening, discharging and rinsing a container comprising a vessel having a base, side walls means generally upstanding from the base, means defining a first opening in the vessel above the side wall means arranged for insertion of the container through the opening to be received within the vessel and confined by the base and the side wall means for discharge of the contents of the container into the vessel, and a drain opening at the base for discharge of the contents from the vessel, cutting means, means mounting the cutting means in the vessel for cutting open a wall of the container, the cutting means being arranged to face the opening such that movement of the container along an insertion direction through the opening through the cutting means causes said cutting, spray means, and means mounting the spray means within the vessel so as to spray a rinsing agent into the container through the cut wall of the container, the cutting means comprising at least one elongate blade member arranged to cut an elongate slit in the wall of the container and being shaped and arranged to open the container at the wall to form an opening greater in size than the cut slit to allow rapid discharge of the contents of the container.

According to a second aspect of the invention there is provided a device for opening, discharging and rinsing a container comprising a vessel having a base, side walls means generally upstanding from the base, means defining a first opening in the vessel above the side wall means arranged for insertion of the container through the opening to be received within the vessel and confined b the base and the side wall means for discharge of the contents of the container into the vessel, and a drain opening at the base for discharge of the contents from the vessel, cutting means, means mounting the cutting means in the vessel for cutting open a wall of the container, the cutting means being arranged to face the opening such that movement of the container along an insertion direction through the opening through the cutting means causes said cutting, spray means, and means mounting the spray means within the vessel so as to spray a rinsing agent into the container through the cut wall of the container, the cutting means comprises a first elongate blade member arranged to cut an elongate slit in the wall of the container and at least one second elongate blade member extending transversely to said first elongate blade member so as to cut a second slit in the wall of the container, the blade members being connected at an apex and each blade member extend downwardly and outwardly from the apex such that the apex is arranged to engage the wall of the container to provide an initial penetration thereof with the blade members cutting slits outwardly from the initial penetration.

According to a third aspect of this invention there is provided a device for opening, discharging and rinsing a container comprising a vessel having a base, side walls means generally upstanding from the base, means defining a first opening in the vessel above the side wall means arranged for insertion of the container through the opening to be received within the vessel and confined by the base and the side wall means for discharge of the contents of the container into the vessel, and a drain opening at the base for discharge of the contents from the vessel, cutting means, means mounting the cutting means in the vessel for cutting open a wall of the container, the cutting means being arranged to face the opening such that movement of the container along an insertion direction through the opening through the cutting means causes said cutting, spray means, means mounting the spray means within the vessel so as to spray a rinsing agent into the container through the cut wall of the container, and discharge duct means connected to the drain opening, the discharge duct means including inlet means for supplying to the discharge duct means a transport fluid, outlet means for discharging the transport fluid for supply to a container to be filled with the contents and the transport fluid, and means for mixing the discharge contents from the drain opening into the transport fluid.

The present device can therefore destructively open the entire bottom of a chemical container, full or otherwise, within a confined vessel. The container contents drain into the vessel and from there can be communicated by a pipe system connected to a sprayer tank. The device also rinses the interior of the container and drains the water and residual chemical into a drain opening of the vessel. Discharge therefore takes place very rapidly allowing use of only a single discharge station. This can enable the whole device to be relatively small and transportable for use directly on or with a field sprayer.

The device helps to prevent the waste of chemical within the container, and is preferably constructed to minimize the spilling of same while the container is being emptied and rinsed. The device can be arranged so that one person may operate the device and have minimal contact with the chemicals, one container at a time. It also may be used on containers of different sizes or made from different materials, so long as the container fits within the opening.

BRIEF DESCRIPTION OF THE DRAWINGS

In drawings which illustrate embodiments of the invention.

DETAILED DESCRIPTION

Figure 1:
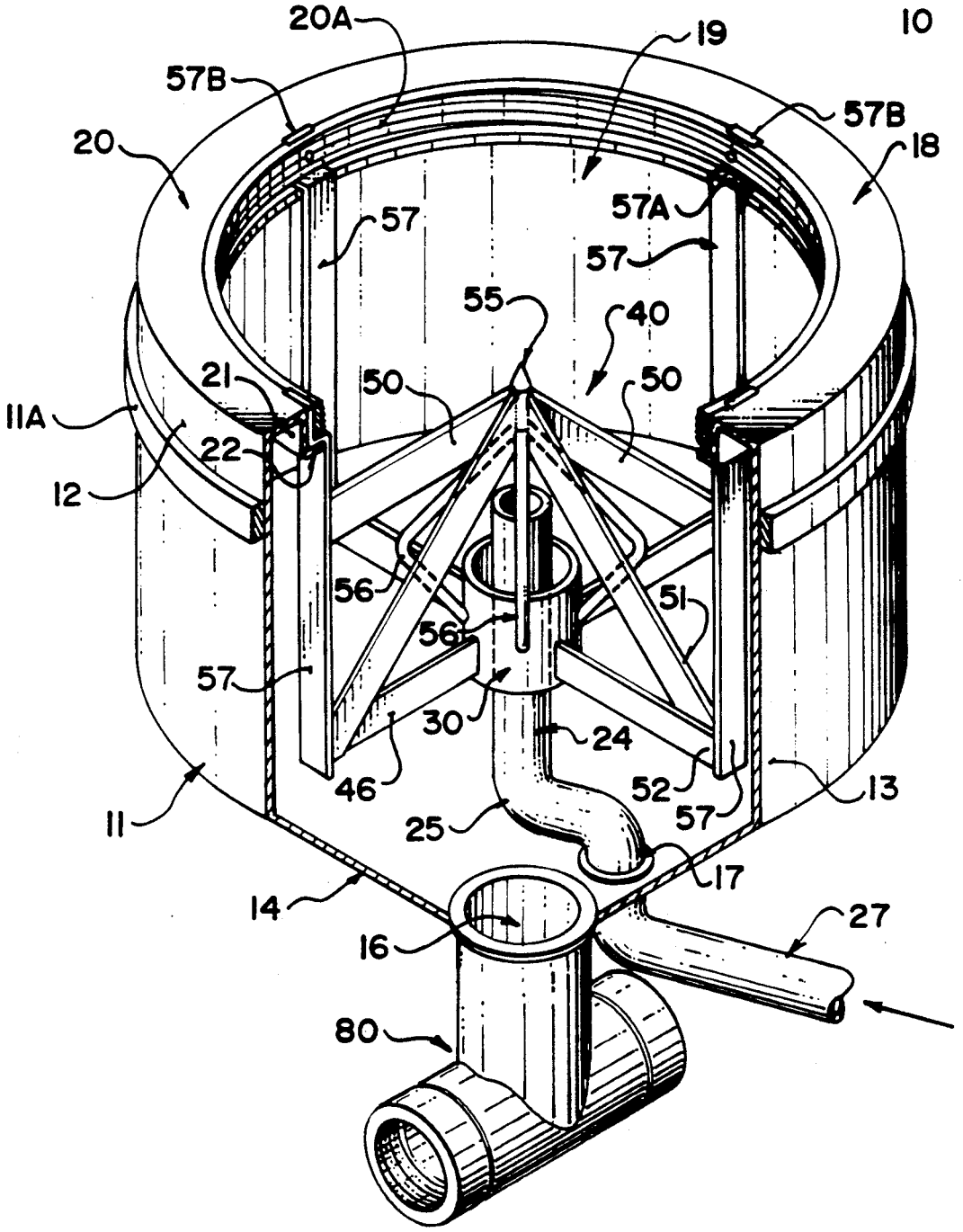
FIG. 1 is an isometric view partly broken away of the device according to the present invention.
Figure 2:
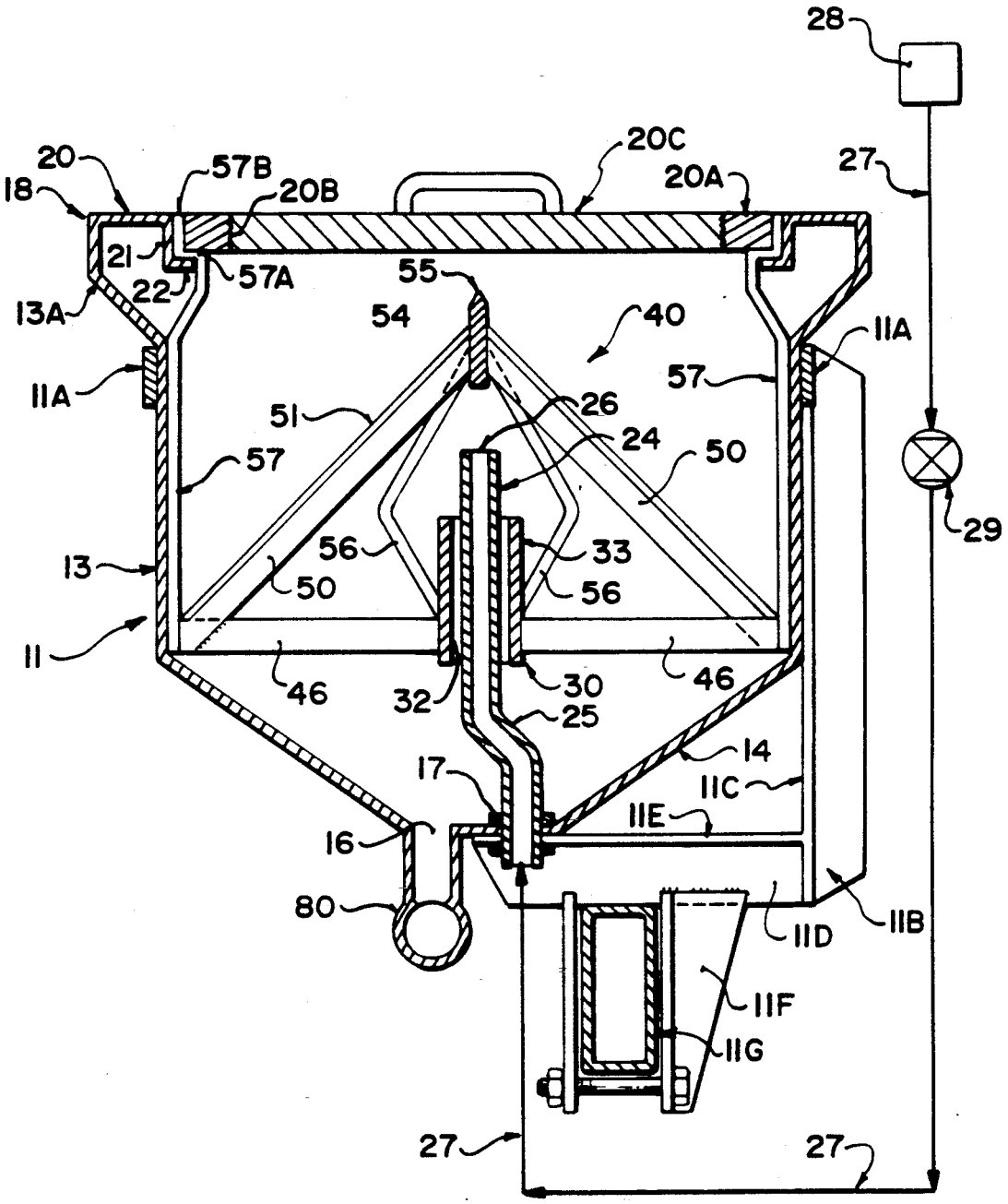
FIG. 2 is a vertical cross sectional view of the device of FIG. 1, in operation.
Figure 3:
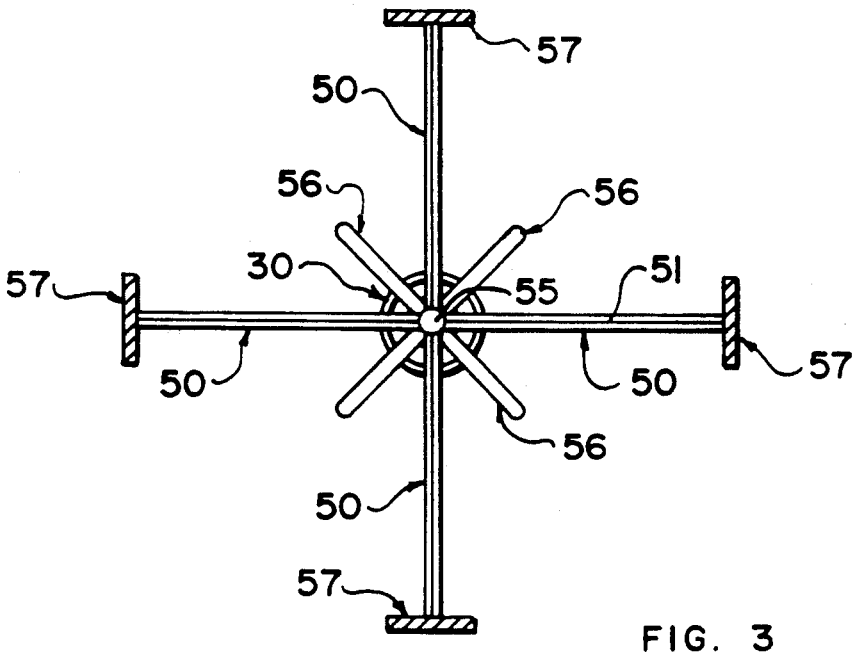
FIG. 3 is a partial top plan view of the device of FIG. 1.

A discharge and rinsing device is shown generally at 10. The device is comprised of a single vessel 11 having an upper cylindrical portion 12 defining a side wall 13 integral with a lower conical portion 14 defining a base, the wall 13 extends downwardly from an upper rim 18 to the base 14 at which there is a drain opening 16 and an inlet opening 17. The wall 13 includes a step 13A defining a shoulder against which a support band can engage.

The rim 18 extends around the top of the cylindrical wall 13, and defines an opening 19, into the vessel 11. The rim is comprised of an annular flange or ring 20 which extends inwardly at right angles to the wall 13, a depending portion 21 and an outwardly turned flange lip 22. The return defined by the flange 20 and the depending portion 21 acts to restrain any liquid forced up the wall 13 by the downward thrust of the container into the vessel.

An elongate spray tube 24 extends upwardly into the vessel 11, through the inlet opening 17 at the base of the vessel at a position offset from the center. The tube 24 extends upwardly within the vessel toward the upper cylindrical portion of the vessel. The tube 24 is bent at 25, so that its upper end portion is aligned with the central axis of the vessel. The tube has an opening 26 at its upper end, positioned centrally within the vessel to spray water upwardly from a pipe 27 having a valve 29 thereon and connected to a source 28.

The vessel 11 is fastened to a bracket assembly, comprising a surrounding band 11A which is attached to an angle bracket 11B including a vertical angle iron 11C and a horizontal angle iron 11D extending to a position at the base at the inlet opening 17. The flat plate 11E of the angle 11D is attached to the vessel by a bulkhead fitting at the opening 17. A clamp assembly 11F attached the bracket to a beam 11G of a machine on which the device is to be transported, for example the frame of a field sprayer.

A cutting device shown generally at 40 is supported within the upper portion of the vessel 11. A central sleeve 30, having an inner wall 32 and an outer wall 33, slidably fits over the upper portion of the spray tube 24. The upper portion of the sleeve 30 is positioned near the opening on the tube 24. The device has four radially projecting arms 46 connected to and extending outwardly from a lower portion of the outer wall 33 of the sleeve 30. The arms are equally spaced about the outer wall 33 of the sleeve 30, and each arm extends toward the inner side wall surface of the vessel side wall 13.

A 16 gauge stainless steel blade 50, having a sharp upper edge 51, is attached near end 52 of each arm 46, remote to the sleeve 30. Each blade extends upwardly and inwardly from the end 52 of the arm 46. The four blades converge to form an apex 54, centrally positioned within the vessel, above the top of the opening 26 of the tube 24, and below the horizontal plane of the opening 19 as defined by the rim 18 of the vessel 11. A pointed rod member 55 projects upwardly from the apex 54. The top of the rod member is positioned below the horizontal plane of the opening 19 as defined by the rim 18.

Four rods 56 are positioned on the sleeve 30 each between a pair of the blades 50. The rod each include a first portion extending outwardly from the sleeve to an extent less than the radial extent of the blades and a second position extending upwardly and inwardly therefrom to connect with the rod member 55.

An upwardly extending elongate flat metal strap 57 is attached to an end position 52 of each radial arm 46. Each strap 57 extends upwardly therefrom, towards the rim 18. The upper portion of each member 57 has an outwardly projecting portion 57A and a vertical portion 57B that fit within a recess defined in the lip 22 and depending portion 21 respectively which acts to locate the strap. The straps 57 thus support the cutting apparatus centrally within the upper portion of the vessel 11. When the cutting apparatus is in place, a locating 20A is positioned over the portion 57A. The ring 20A is fastened to the depending portion 21 of the vessel by screws extending through the ring 20A and into the wall 21. The ring 20A holds the projecting portion 57A of the member 57 in the respective recess, thereby supporting the perforating apparatus within the upper portion of the vessel 11. An inwardly facing surface 20B of the ring 20A is threaded to receive a lid 20C which closes the opening when the device is not in use.

Figure 4:
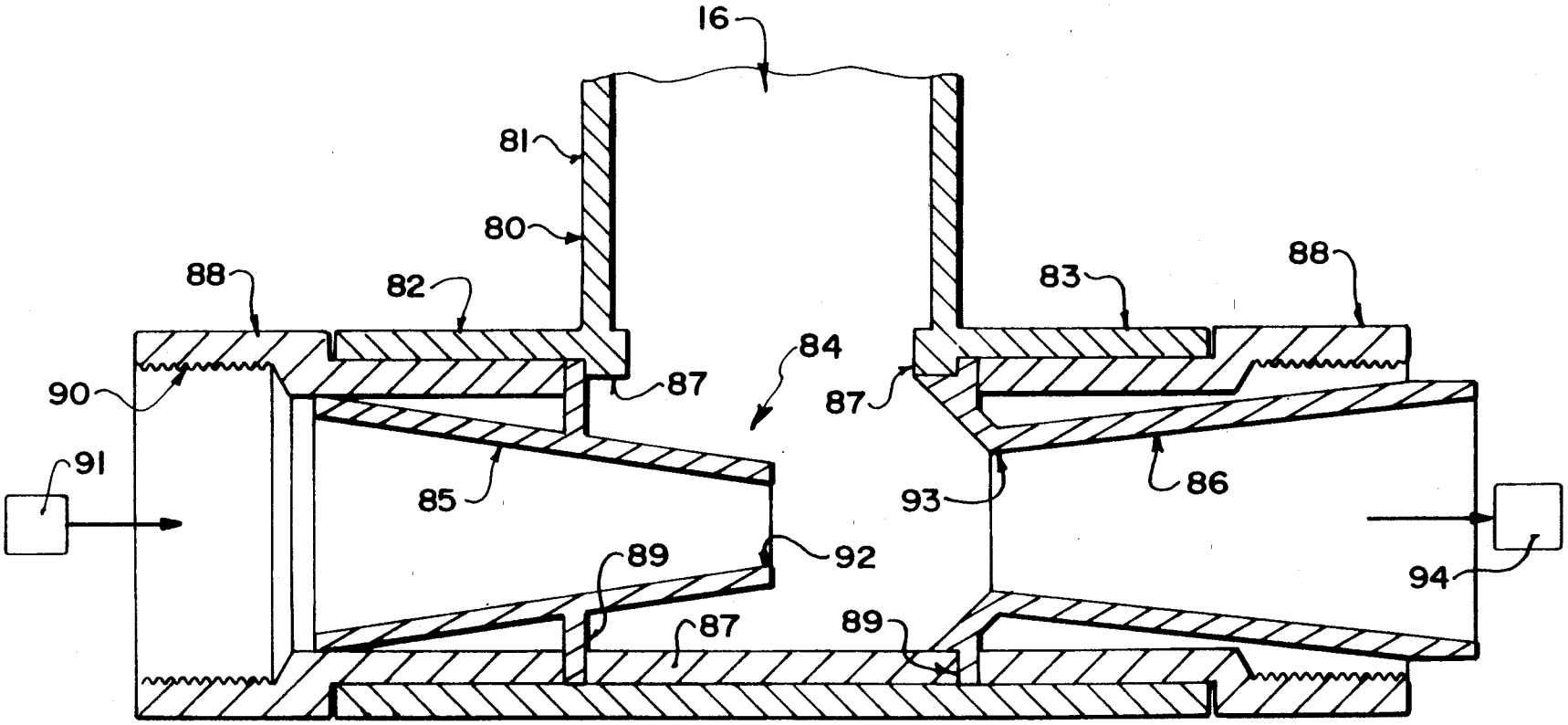
FIG. 4 is a cross-sectional view of the drain discharge duct of FIG. 1.

The discharge outlet is attached to the drain 16 is shown in FIG. 4 and this comprises a T-fitting 80 having a leg 81 and two arms 82 and 83. A venturi arrangement 84 is provided within the T-fitting and includes an inlet nozzle arrangement 85 an outlet nozzle 86. Each of the inlet and outlet nozzles is clamped between an abuttment 87 on the T-fitting and a connector piece 88 which is pressed into the end of the respective arm of the T-fitting to clamp a flange 89 of the nozzle between the abuttment 87 and an end face of the connector piece 88.

The connector piece therefore comprises a sleeve which slides inside the arm 82 and the female screw threaded section 90 for attachment to a hose or supply line.

The inlet nozzle 85 defines a frusto-conical sleeve through which the transport liquid from a source 91 passes. At the end of a mouth 92 of the inlet nozzle, the liquid is released into a suction zone which draws the liquid through the outlet opening 16 into the T-fitting for injection into the outlet nozzle 86. The outlet nozzle defines a throat 93 into which the transport liquid is injected with the material from the outlet opening 16 to be carried through the gradually outwardly tapering nozzle 86 for supply through a further duct to a receiving container 94.

Figure 5:
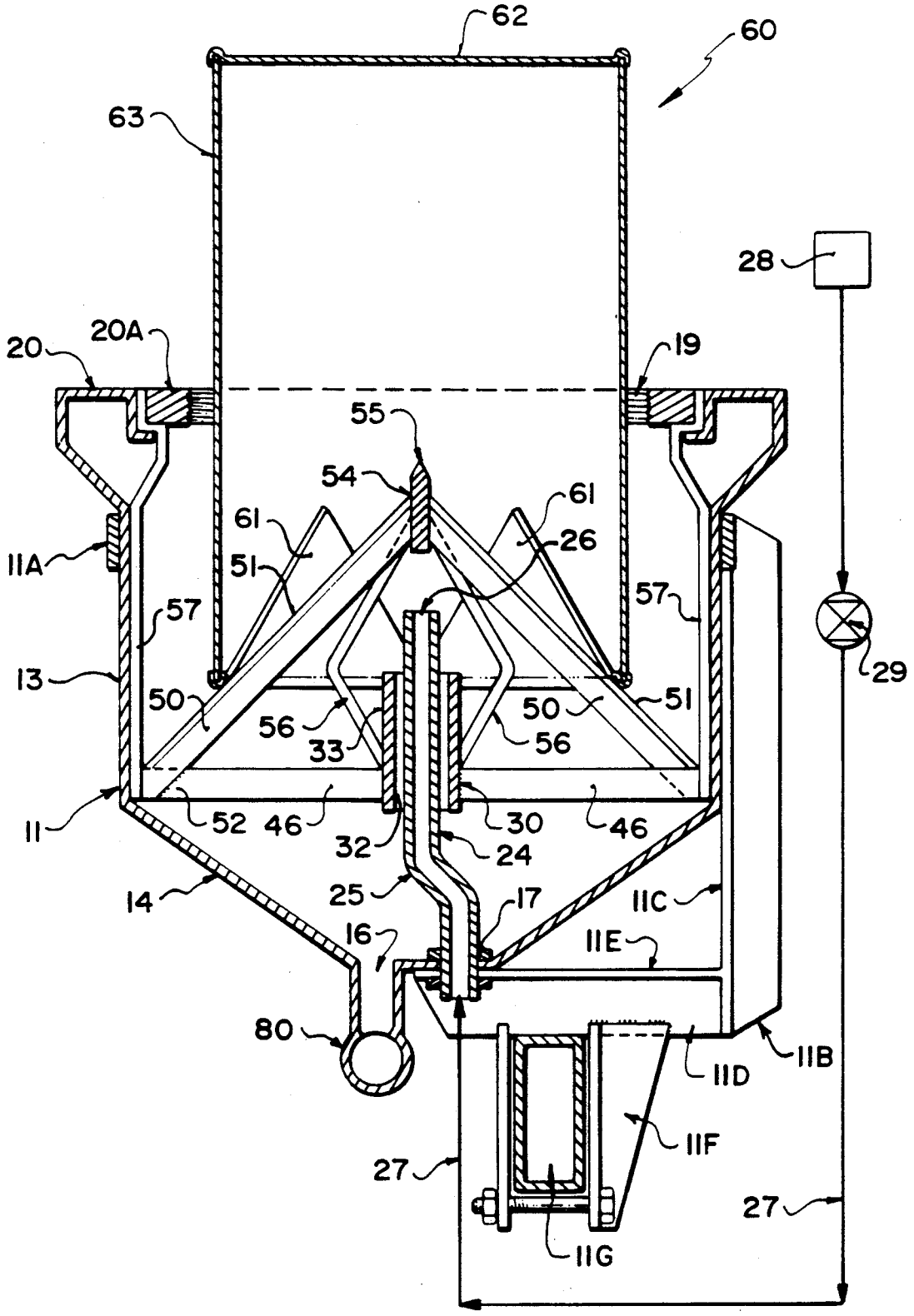
FIG. 5 is a view similar to that of FIG. 2 showing a container opened within the vessel.

In operation, as illustrated in FIG. 5, a container 60 is positioned in the opening 19 of the vessel 11, so that the pointed rod member 55 above the apex 54 of the blades 50, engages a central portion of the bottom wall 61 of the container. The container 60 is manually forced downwardly by pushing its top 62 and/or side 63, into the vessel opening 19, so that the force on the container, along with its own weight, causes the rod member 55 to pierce the bottom wall 61 of the container 60. A continued application of downward force causes the container 60 to move toward the radial arms 46 within the vessel 11. As a result, each blade member 50 cuts an elongate slit in the base so that the entire bottom 61 of the container is cut open into four pieces and peeled away along the upper edge 51 at each blade 50. The pieces abut the rods 56 positioned between the blades, and the pieces move away from the center of the bottom of the container, guided by the rods 56.

When the bottom of the container 60 is opened, the contents quickly discharge into the vessel 11, as the blades 56 and spray tube positioned below the apex 54 enter the interior of the container 60.

The interior of the container is rinsed by an activation of a water or other rinsing agent source, and the movement of the water through the spray tube 24. The water exits the top 26 of the spray tube 24, hits the blades 50 above the opening, and disperses upwardly in many directions. The upper rim 18 including the ring 20 and the depending portion 21 attached thereto, act to prevent spills upwardly and outwardly of the opening 19, and keep all chemical and rinse water within the vessel 11.

The chemical and rinse water drain out of the drain 16 of the vessel 11, and into a pipe 28. The rinse water and chemical is carried, by one of many possible systems described below, to a sprayer tank for agitation prior to spraying.

Figure 6:
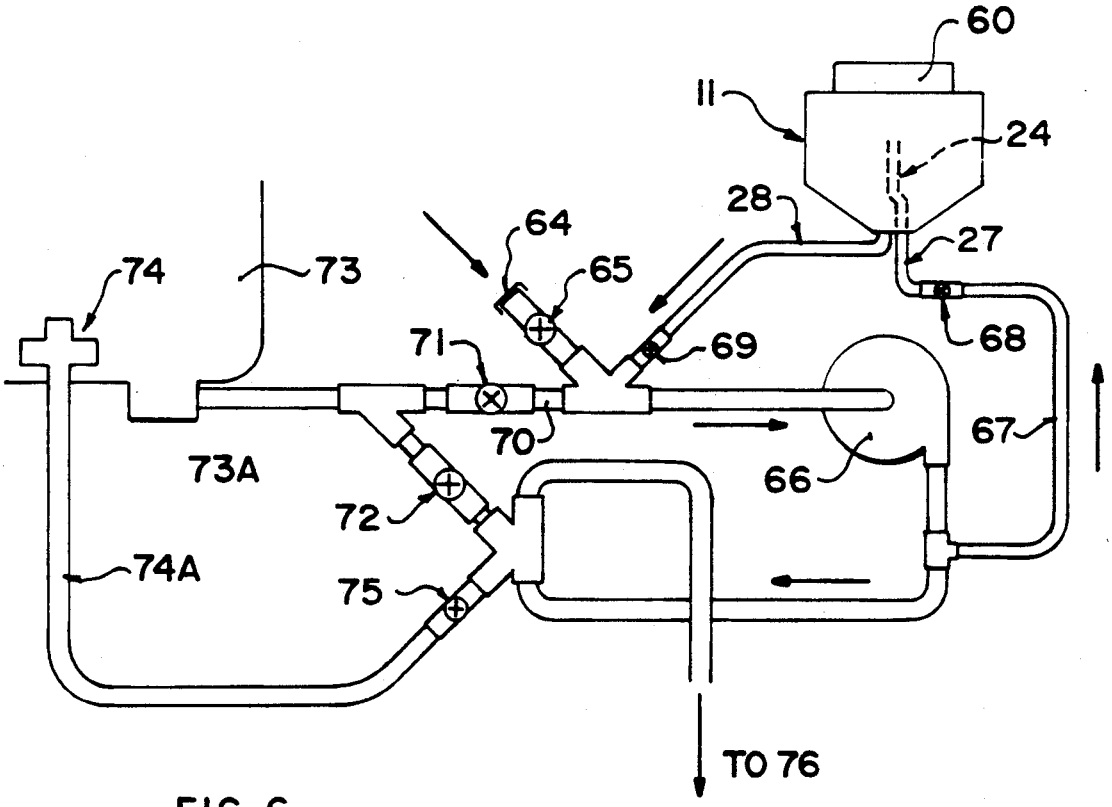
FIG. 6 is a schematic representation of the device in combination with a system including a sprayer pump.
Figure 7:
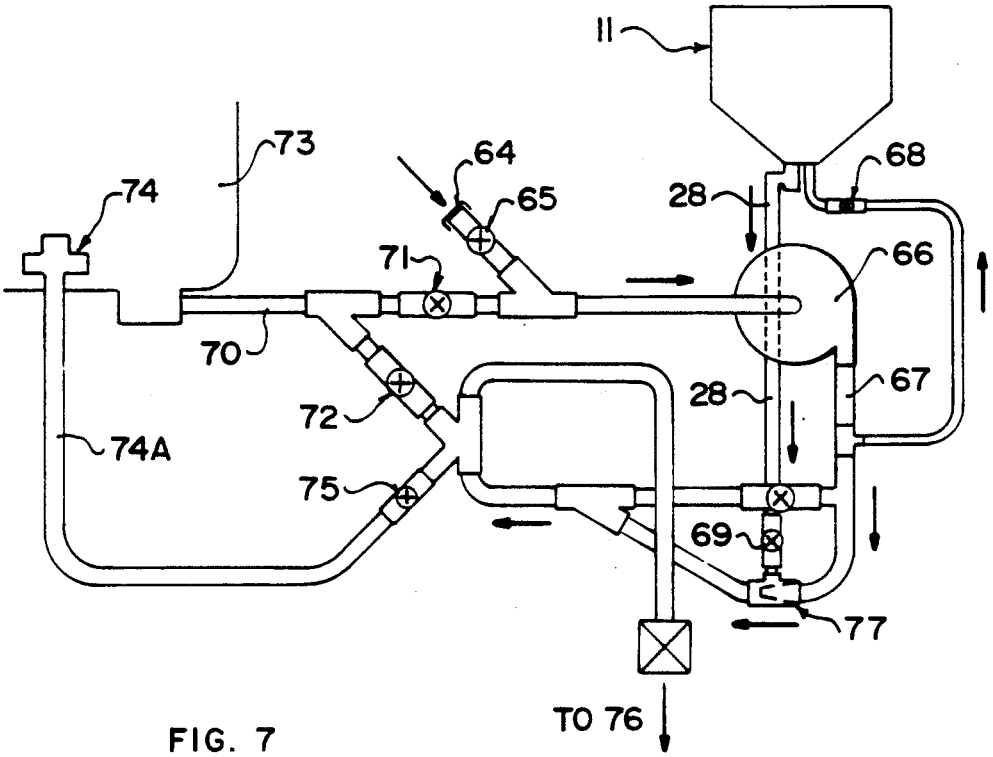
FIG. 7 is a schematic representation of the device in combination with a system including an aspirator.
Figure 8:
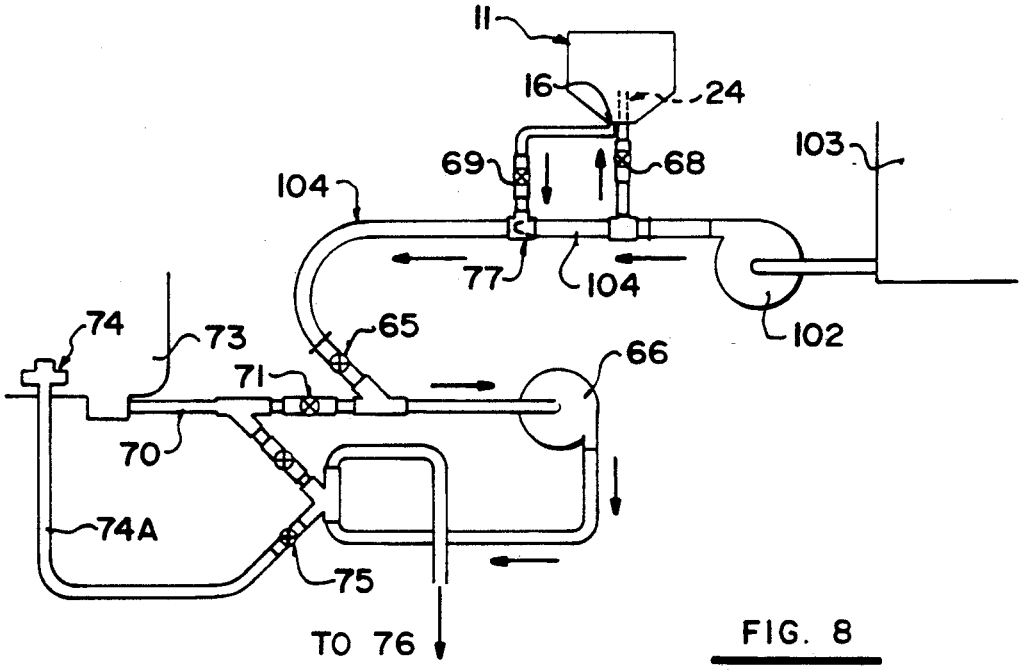
FIG. 8 is a schematic representation of the device in combination with a system mounted on either a water truck or sprayer.

FIGS. 6, 7 and 8 illustrate various schematic arrangements of sprayer tank circulation systems that could be used in combination with the device.

With reference to FIG. 6, water, or other rinsing agent as indicated by direction arrows is supplied through inlet 64, through open valve 65 and into a pump 66. The water is then pumped along pipe 67, through valve 68 and pipe 77 into spray tube 24 within the vessel 11. The water rinses a chemical container 60 as described, and the chemical and rinse water drain through drain 16 into a pipe 28. The mixture then moves through valve 69 and along pipe 70, through the pump 66, through open valve 75, pipe 74A, and into a spray tank 73.

Once the container 60 is emptied and thoroughly rinsed, and the chemical and water have been moved to the sprayer tank for mixing, the water supply is turned off and the container 60 is removed from the vessel 11. The valves 65, 68 and 69 are closed disconnecting the vessel 11 from the liquid circuit. When the spray tank is filled, the contents can be agitated by injection through an agitator 74 positioned within the tank and withdrawn through a sump 73A, open valve 71, pump 66 and open valve 75. When agitation is complete, the mixed chemical and water is moved along pipe 70 from the sprayer tank sump 73A, through open valve 71, the pump 66 and into the spray boom 76.

With reference to FIG. 7, an aspirator portion or venturi 77 has been added to the system to aid in the movement of water and chemical from the outlet of the vessel 11 to the sprayer tank 73. The rinse water and chemical move from the vessel 11 along the pipe 28, through open valve 69 and into the venturi 77 in which suction is developed by the flow of water through the pump 66 into the line 67.

With reference to FIG. 8, a device is illustrated having a venturi 77 thereon, and a second supply pump 102, in combination with a supply tank 103 which can be mounted on a water truck or on the sprayer. The pump 102 pumps water through the venturi 77, and into the spray nozzle of the vessel 11 from a line 104. The water enters the spray tube 24 as described above and exits the vessel 11 through the drain 16 into pipe 28 and from there through the valve 64 into the venturi 77. The mixed chemical and rinse water then pass into the open valve 65 and either to the pump 66 or through the valve 71, and then to the spray tank 73 for agitation prior to spraying.

As many chemicals are provided in concentrated form for later dilution, the chemical from the container, and rinse water removed therefrom, is used to fill a sprayer tank. Since the amount of chemical used is a known amount, and the volume held by the sprayer tank in a known amount, the volume of water used to dilute the chemical is easily determined. The result is a minimal waste and maximum use of the chemical.

The device may also be used to rinse used containers as well, as containers open and used by other means may have a chemical residue therein that must be removed prior to disposal.

Containers of various sizes, materials and volume, may be opened and rinsed by the device so long as they fit within the opening of the vessel. When a smaller container is opened, the blades cut the side walls of the container as well as the bottom wall.

The rinsing device herein allows the operator to perform the method without directly contacting the chemical within the container. The design of the device also minimizes spillage from the container as the upper rim 18 and ring 20 help to contain any spills within the vessel.

The device is designed for use by an individual or company that uses chemical containers in its daily operation. It is also designed for use by one person to empty and rinse chemical container one at a time. Once a container has been opened and rinsed it generally has no further use, other than scrap, and it may be disposed of in accordance with local laws.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method for opening, discharging and rinsing a container, the container comprising a first end wall, a second end wall and a peripheral wall, the peripheral wall having an area of maximum transverse dimension, the first end wall extending to the peripheral wall at a position thereon at the area of maximum transverse dimension, the method comprising providing a vessel having a base and side wall means generally upstanding from the base, defining a first opening in the vessel above the side wall means, inserting the container in a direction of insertion movement through the opening with the first end wall inserted firstly into the first opening so that at least part of the container, including the first end wall and at least a part of the area of maximum transverse dimension of the peripheral wall, is received within the vessel and confined by the base and the side wall means for rapid discharge of the contents of the container into the vessel, providing a drain opening at the base for discharge of the contents from the vessel, providing cutting means in the vessel arranged for cutting open a wall of the container, arranging the cutting means to face the opening moving the container along said insertion direction through the opening to the cutting means to cause said cutting, and spraying a rinsing agent into the container through the cut wall of the container, the cutting means comprising at least one elongate blade member arranged to cut an elongate slit in said first end wall of the container, the slit extending across substantially the whole of the first end wall from a position adjacent the peripheral wall at one end of the slit to a position adjacent the peripheral wall at an opposed end of the slit and the cutting means being shaped and arranged to open the container at the wall to form an opening greater in size than the cut slit to allow said rapid discharge of the contents of the container.

2. A method for opening, discharging and rinsing a container, the container comprising a first end wall, a second end wall and a peripheral wall, the peripheral wall having an area of maximum transverse dimension, the first end wall extending to the peripheral wall at a position thereon at the area of maximum transverse dimension, the method comprising providing a vessel having a base and side wall means generally upstanding from the base, defining a first opening in the vessel above the side wall means, inserting the container in a direction of insertion movement through the opening with the first end wall inserted firstly into the first opening so that at least part of the container, including the first end wall and at least a part of the area of maximum transverse dimension of the peripheral wall, is received within the vessel and confined by the base and the side wall means for rapid discharge of the contents of the container into the vessel, providing a drain opening at the base for discharge of the contents from the vessel, providing cutting means in the vessel arranged for cutting open a wall of the container, arranging the cutting means to face the opening, moving the container along said insertion direction through the opening to the cutting means to cause said cutting, and spraying a rinsing agent into the container through the cut wall of the container, the cutting means comprising a first elongate blade member arranged to cut an elongate slit in the wall of the container and at least one second elongate blade member extending transversely to said first elongate blade member so as to cut a second elongate slit in the wall of the container, each of the first and second slits extending across substantially the whole of the first end wall from a position adjacent the peripheral wall at one end of the slit to a position adjacent the peripheral wall at an opposed end of the slit the blade members being connected at an apex and each blade member extending downwardly and outwardly from the apex such that the apex is arranged to engage the wall of the container to provide an initial penetration thereof with the blade members cutting said first and second slits outwardly from the initial penetration to said peripheral wall.

3. The method according to claim 1 including engaging the cut first end wall of the container separately from said blade means for opening the cut first end wall to form said opening therein for discharge of the contents.

4. A device for opening, discharging and rinsing a container comprising a vessel having a base, side walls means generally upstanding from the base, means defining a first opening in the vessel above the side wall means arranged for insertion of the container through the opening to be received within the vessel and confined by the base and the side wall means for discharge of the contents of the container into the vessel, and a drain opening at the base for discharge of the contents from the vessel, cutting means, means mounting the cutting means in the vessel for cutting open a wall of the container, the cutting means being arranged to face the opening such that movement of the container along an insertion direction through the opening through the cutting means causes said cutting, spray means, means mounting the spray means within the vessel so as to spray a rinsing agent into the container through the cut wall of the container, and discharge duct means connected to the drain opening, the discharge duct means including inlet means for supplying to the discharge duct means a transport fluid, outlet means for discharging the transport fluid for supply to a container to be filled with the contents and the transport fluid, and means for mixing the discharge contents from the drain opening into the transport fluid.

5. The device according to claim 4 wherein the mixing means comprises a venturi.

* * * * *